US008109018B2

(12) United States Patent
Maurer

(10) Patent No.: US 8,109,018 B2
(45) Date of Patent: Feb. 7, 2012

(54) IRON TOTE

(76) Inventor: Scott Maurer, Rocky River, OH (US)

( * ) Notice: Subject to any disclaimer, the term of this patent is extended or adjusted under 35 U.S.C. 154(b) by 271 days.

(21) Appl. No.: 12/541,219

(22) Filed: Aug. 14, 2009

(65) Prior Publication Data

US 2011/0035974 A1 Feb. 17, 2011

(51) Int. Cl.
*D06F 79/02* (2006.01)
*D06F 79/00* (2006.01)

(52) U.S. Cl. ..... 38/142; 248/117.2

(58) Field of Classification Search ..... 219/259; 248/117.1–117.7; 38/79, 88, 96.106, 107, 38/142
See application file for complete search history.

(56) References Cited

U.S. PATENT DOCUMENTS

| | | | | |
|---|---|---|---|---|
| 623,055 | A | 4/1899 | Weiss et al. | |
| 853,300 | A | 5/1907 | Erickson | |
| 1,665,316 | A | 4/1928 | Matthews | |
| 2,108,581 | A | 2/1938 | Duffy | |
| 2,191,649 | A * | 2/1940 | Gey | 248/117.1 |
| 2,254,955 | A | 9/1941 | Yett | |
| 2,439,004 | A | 4/1948 | Hurley | |
| 2,514,400 | A | 7/1950 | Larkins | |
| 2,603,438 | A * | 7/1952 | Adams | 248/117.1 |
| 3,202,389 | A * | 8/1965 | Zoffer | 248/117.4 |
| 3,250,030 | A * | 5/1966 | Lapastora | 38/142 |
| 3,459,398 | A | 8/1969 | Agrusa | |
| 3,483,954 | A | 12/1969 | Michalski | |
| 3,951,369 | A | 4/1976 | Kocsak | |
| 3,967,802 | A | 7/1976 | Lomagno | |
| 4,893,770 | A * | 1/1990 | Bejak et al. | 248/117.1 |
| 5,730,396 | A * | 3/1998 | Fovall | 248/51 |
| 6,263,597 | B1 | 7/2001 | Bric | |
| 7,004,433 | B2 * | 2/2006 | Clausen et al. | 248/117.1 |
| RE39,945 | E | 12/2007 | Brown | |
| 2004/0055927 | A1 | 3/2004 | McNutt et al. | |

FOREIGN PATENT DOCUMENTS

| | | |
|---|---|---|
| JP | 61179198 | 8/1986 |

* cited by examiner

*Primary Examiner* — Ismael Izaguirre
(74) *Attorney, Agent, or Firm* — Rankin Hill & Clark LLP

(57) ABSTRACT

An iron tote includes a soleplate rest, an iron seat, a cord guide, and a wall stand. The soleplate rest defines a soleplate resting surface for the soleplate of an associated iron. The iron seat connects with and projects generally forwardly from the soleplate rest. The iron seat defines a heel resting surface oriented generally normal with respect to the soleplate resting surface. The cord guide connects with the soleplate rest above the iron seat. The cord guide can have a contoured contact surface along which an electrical cord of the associated iron rides during operation of the iron. The wall stand connects with and projects generally rearwardly from the soleplate rest. A method of operating an iron and a kit are also disclosed.

18 Claims, 4 Drawing Sheets

IRON TOTE

BACKGROUND

The present disclosure generally relates to a device for carrying a steam iron. When one desires to iron, or press, an article of clothing, the steam iron, and other accessories, e.g., spray starch, water spray and lint roller, are typically stored separately and awkwardly carried to the ironing board as separates. The iron and accessories are set onto the ironing board surface during the ironing operation, consuming valuable ironing board space. Moreover, the accessories, e.g., the spray starch, the water spray and the lint roller, when located on the ironing board are prone to tipping and falling to the floor. If the ironing board is bumped or jiggled during use, equipment on the board, such as the iron and accessories, easily tips and falls. In the presence of children or pets, such incidents can be highly undesirable because of the extreme heat of the iron.

Most irons include an electrical cord that is plugged into an electrical socket to deliver electrical energy to the heating element of the iron. The electrical cord projects from the heel of the iron and toward the operator. Because of this configuration, the electrical cord often becomes entangled underfoot and further tangles and interferes with items on the ironing board.

In addition to the aforementioned problems, accessing the iron and ironing accessories can be difficult, awkward and inefficient during an ironing operation. Moreover, the ironing board cannot be easily moved or repositioned during use due to the likelihood of equipment that is resting on the ironing board falling from the ironing board. Finally, putting the iron and accessories away after use requires the same awkward handling as bringing them out, e.g. the steam iron, spray starch, water spray and lint roller are typically carried from the board as separates.

BRIEF DESCRIPTION

An iron tote that can overcome the aforementioned shortcomings includes a soleplate rest, an iron seat, a cord guide, and a wall stand. The soleplate rest defines a soleplate resting surface for the soleplate of an associated iron. The iron seat connects with and projects generally forwardly from the soleplate rest. The iron seat defines a heel resting surface oriented generally normal with respect to the soleplate resting surface. The cord guide connects with the soleplate rest above the iron seat. The cord guide can have a contoured contact surface along which an electrical cord of the associated iron rides during operation of the iron. The wall stand connects with and projects generally rearwardly from the soleplate rest.

The iron tote can further include an accessory shelf connected with and projecting from a side of the soleplate rest. The accessory shelf can include a base defining a generally planar support surface and a support wall projecting upwardly from the base and defining a curved support surface. The generally planar support surface can be substantially co-planar with the heel resting surface. The soleplate rest and the iron seat can be a wire frame construction and the accessory shelf can be made from a material that is substantially devoid of openings.

The wall stand can pivot with respect to the soleplate rest. The wall stand can pivot between a first position and a second position. When in the first position, the wall stand can be configured to contact an associated vertical wall to position the soleplate resting surface at least about 15 degrees with respect to vertical. The iron tote can further include side members connected with the soleplate rest. The wall stand can include a stop on the wall stand that contacts at least one of the side members when the wall stand is in the first position.

The soleplate rest can include left and right soleplate rest side members interconnected by a plurality of cross members. The soleplate rest side members and the cross members can be made from wire. The iron seat can include a portion of a wire elements that includes rear side members rearwardly offset from the soleplate rest side members. The iron tote can further include a lifting handle connecting the soleplate rest side members to the rear side members. The rear side members can include a left rear side member and right rear side member.

An ironing accessory kit can include the aforementioned iron tote in combination with a cord clip configured to adhere to the housing of an associated iron. A method of operating an iron includes holding an electrical cord for the iron against a housing of the iron adjacent a nose of the iron using the aforementioned clip.

An iron having a "cord forward" orientation generally includes a housing, a soleplate, a heating element and an electrical cord. For the iron having the "cord forward" orientation, the electrical cord extends from a nose of the iron.

DETAILED DESCRIPTION

Figure 1:
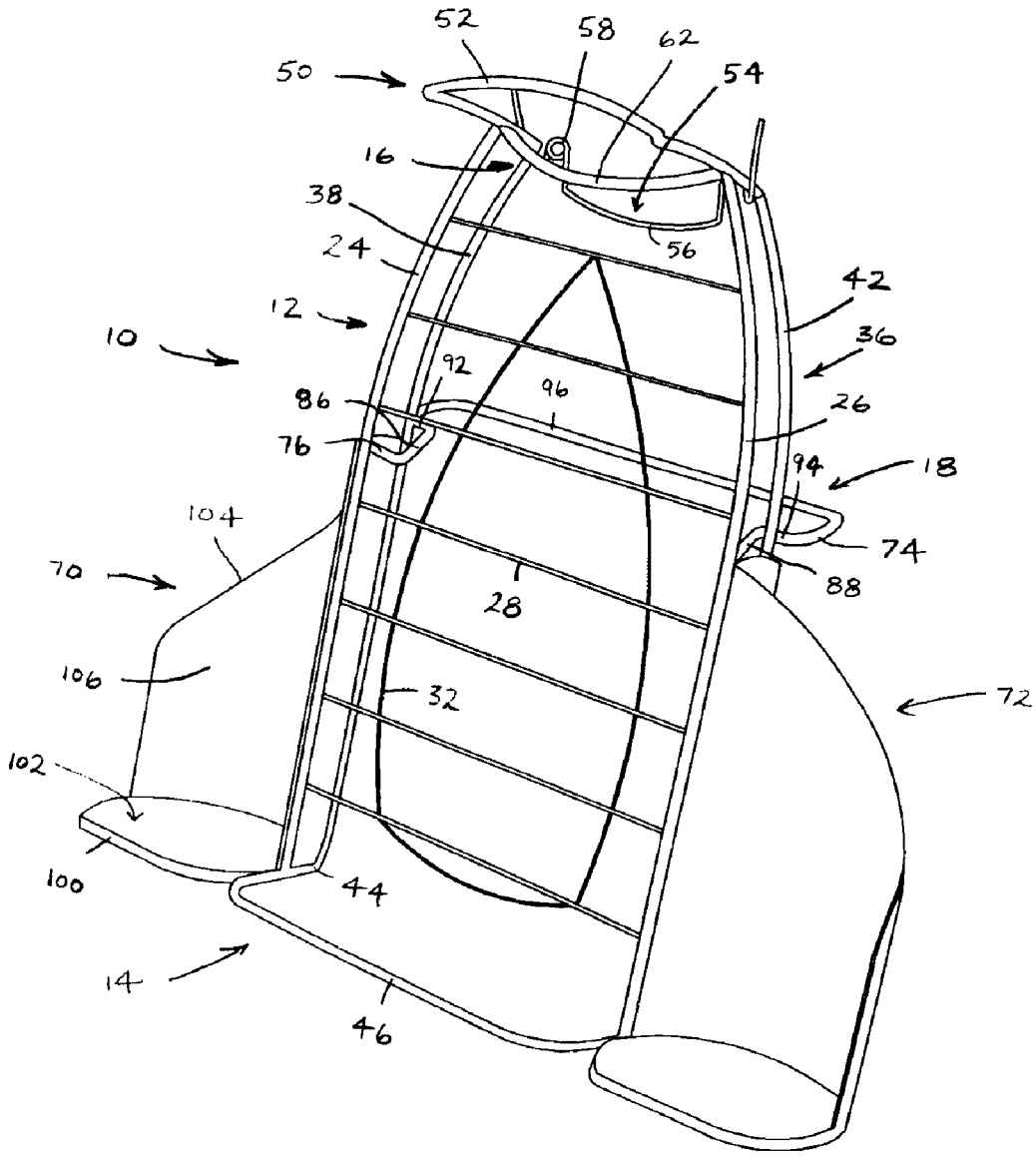
FIG. 1 is a front perspective view of an iron tote.

With reference to FIG. 1, an iron tote 10 includes a soleplate rest 12, an iron seat 14, a cord guide 16, and a wall stand 18. The iron tote 10 can provide a convenient device for carrying a steam iron I (FIG. 2) as well as other accessories, e.g. spray starch, water spray and lint roller, that are commonly used in an ironing operation. By using the iron tote 10, the steam iron and accessories that were typically set on an ironing board surface during use can now be located in a convenient location off of the ironing board surface. The iron tote 10 can be made from a wire frame construction and a heat resistant material, e.g. metal.

The soleplate rest 12 in the depicted embodiment defines a sole plate resting surface 22 (FIG. 2) for the soleplate SP of the iron I. In the illustrated embodiment, the soleplate rest 12 is of wire frame construction that includes a left soleplate rest side member 24 and a right soleplate rest side member 26. In an alternative embodiment, the soleplate rest 12, as well as the remainder of the iron tote 10 (described in more detail below) can be made from another construction, e.g. a stamped metal construction, a cast construction, a molded construction. With reference back to the depicted embodiment, the left soleplate rest side member 24 and the right sole plate rest side member 26 are interconnected by a plurality of cross members 28. In the illustrated embodiment, the sole plate rest side members 24 and 26 are generally vertically oriented and the cross members 28 are generally horizontally oriented. Voids exist between the cross members 28 and the side members 24 to facilitate heat dissipation from the soleplate SP (FIG. 2) when the iron I is seated on the iron tote 10. The left side member 24 is spaced from the right side member 26 in a horizontal direction to accommodate the width of a conventional iron, such as the iron I shown at FIG. 2. Also in the depicted embodiment, the soleplate rest 12 can also include an iron outline wire element 32. The iron outline wire element 32 generally follows the periphery of a conventional looking soleplate for an iron to provide a user of the iron tote 10 an indication as to how the iron fits onto the iron tote 10.

Figure 2:
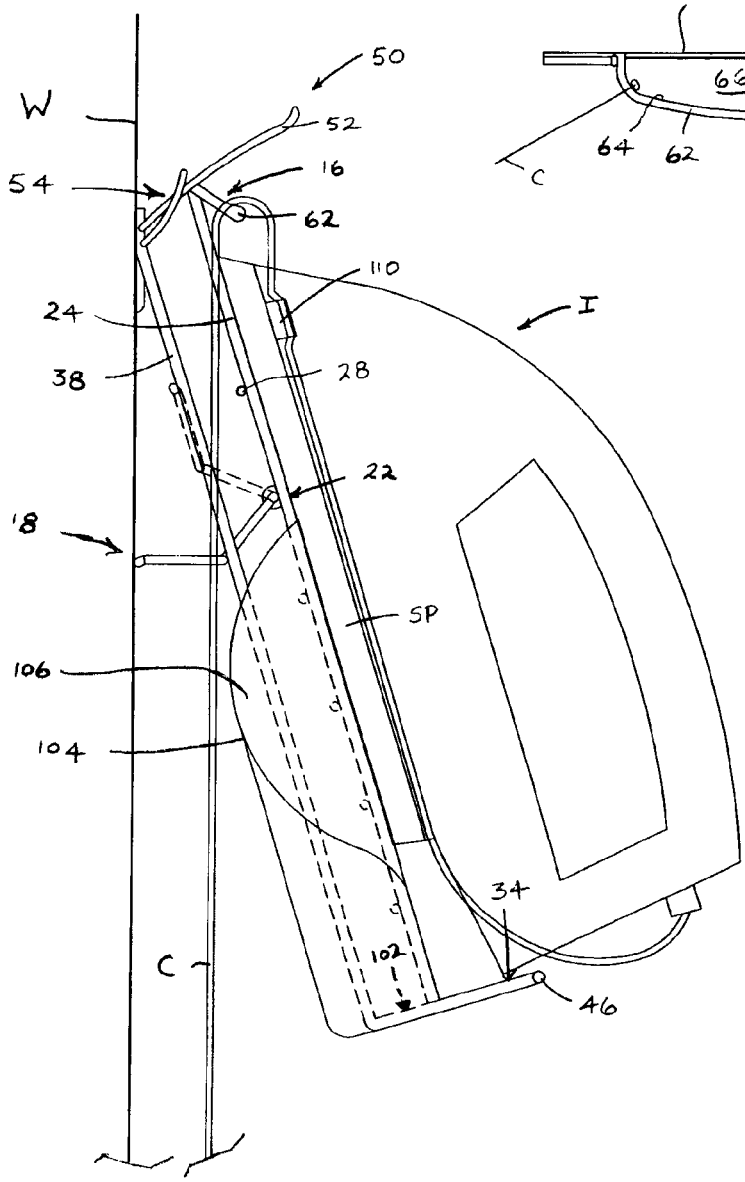
FIG. 2 is a side view of the iron tote of FIG. 1 hung on a vertical wall with a wall stand connected at a different location as that shown in FIG. 1.

With continued reference to FIG. 1, the iron seat 14 connects with the soleplate rest 12 and projects generally forwardly. With reference to FIG. 2, what is meant by the term "forwardly" is that the iron seat 14 projects away from a vertical wall W from which the iron tote 10 is hung. The iron seat 14 defines a heel resting surface 34 that is oriented generally normal to the soleplate resting surface 22. The heel resting surface 34 provides a location for resting the heel of the iron I. The iron seat 14 extends forwardly from the soleplate resting surface 22 less than about 1½ inches, which is enough to provide a sturdy support for the iron I without making removal of the iron from the iron tote 10 cumbersome.

In the depicted embodiment, the iron seat 14 comprises a portion of a wire element 36 that includes rear side members 38 and 42 that are rearwardly offset from the soleplate rest side members 24 and 26. More specifically in the depicted embodiment, the wire element 36 includes a left rear side member 38 that is disposed rearwardly from the left soleplate rest side member 24 and the wire element 36 includes a right rear side member 42 that is rearwardly offset from the right soleplate rest side member 26. The rear side members 38 and 42 are generally vertically oriented and generally parallel to the respective soleplate rest side members 24, 26 that they are disposed behind. The left rear side member 38 bends at a bend 44 transitioning into a generally horizontal portion 46 that resides generally in the same plane as the heel resting surface 34 (FIG. 2). The right rear side member 42 also bends at a bend (not visible) where the right rear side member 42 transitions into the horizontal portion 46. This horizontal portion 46 of the wire element 36 makes up the iron seat 14. As seen in FIG. 1, the left soleplate rest side member 24 terminates at this horizontal portion 46 as does the right soleplate rest side member 26. With the rear side members 38 and 42 offset rearwardly from the soleplate rest side members 24 and 26, a space is provided behind the soleplate resting surface 22 to accommodate an electrical cord C for the iron I that is to be stored on the iron tote 10. As more clearly seen in FIG. 2, the rear side members 38 and 42 appropriately offset the iron tote 10 from the vertical wall W to allow the cord C to be horizontally spaced from the wall W.

With continued reference to FIG. 1, the iron tote 10 includes a lifting handle 50 that allows one to lift the iron tote 10 and any ironing equipment stored on the iron tote. In the depicted embodiment, the lifting handle 50 is made from a wire frame construction, e.g., a wire element 52, similar to the soleplate rest 12 and the iron seat 14 that have been described above. The lifting handle 50 can also be coated with a rubber-like or other flexible material to provide a more comfortable grip for an operator when lifting the iron tote 10. In the depicted embodiment, the lifting handle 50 connects the soleplate rest side members 24 and 26 to the rear side members 38 and 42. The lifting handle 50 projects generally forward (see FIG. 2) so that the iron tote 10 nicely engages the wall as is shown in FIG. 2. Even though the lifting handle 50 is shown as a wire element 52 in the depicted example, the lifting handle can take other configurations and be made from other materials.

With continued reference to the depicted embodiment a hanger 54 cooperates with the iron tote 10 to hang the iron tote from the vertical wall. The hanger 54 in the depicted embodiment is a wire element 56 that includes a left loop feature 58 and a right loop feature (not visible), respectively, for engaging a fastener (not shown) affixed to the wall W (FIG. 2), which can be used to attach the hanger 54 to the vertical wall. The hanger 54 engages the handle 50 between the left soleplate rest side member 24 and the left rear side member 38 and between the right soleplate rest side member 26 and the right rear side member 42, respectively.

With continued reference to the illustrated embodiment, the iron tote 10 also includes the cord guide 16 that is connected with the soleplate rest 12 above the iron seat 14. The cord guide 16 in the depicted embodiment is a wire element 62 having a contoured contact surface 64 along which the electrical cord C for the iron I rides during operation of the iron I, which will be described in more detail below. The cord guide, and more particularly the contact surface 64, can be coated with a material that reduces the friction between the contact surface and the electrical cord C so that the electrical cord can ride freely along the contact surface. The cord guide 16 in the depicted embodiment is generally U-shaped having its terminal ends connected to a respective soleplate rest side members 24 and 26. In the depicted embodiment, the wire element 62 that makes up the cord guide 16 extends forwardly and downwardly from where the wire element 62 connects with the respective soleplate rest side members 24 and 26. As more clearly seen in FIG. 2, this configuration properly locates the electrical cord C for the iron I horizontally from the vertical wall W to which the iron tote 10 is hung. This provides for desirable retraction of the electrical cord C, which will be described in more detail below, during an ironing operation.

Figure 3:
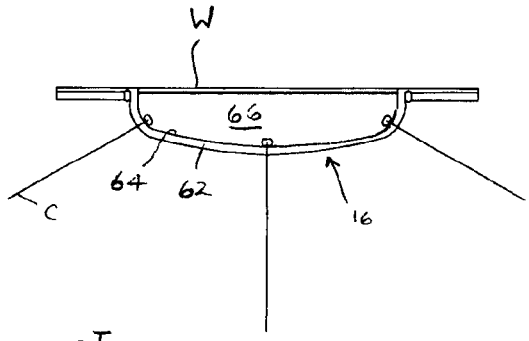
FIG. 3 is a schematic depiction of a cord guide for the iron tote shown in FIGS. 1 and 2 cooperating with an electrical cord of an iron.

With reference to FIG. 3, in plan view the cord guide 16, and more particularly the contact surface 64 thereof, is formed as a compound curve. FIG. 3 schematically depicts the electrical cord C in three different locations (one on the left side of the cord guide 16, one in the center of the cord guide, and one on the right side of the cord guide). As seen in FIG. 7, the electrical cord C is plugged into an electrical socket that is typically well below where the iron tote 10 is hung and the electrical cord rides over the upper surface, which is the contact surface 64, of the cord guide. The electrical cord C enters an opening 66, which is generally defined by the cord guide 16, so that when the iron I is removed from the iron tote 10, which then results in the electrical cord C riding over the cord guide 16, the electrical cord is aligned generally perpendicular to a tangent of the curve of the contact surface 64 at the location where the electrical cord contacts the cord guide. This allows for easy extraction and retraction of the cord with respect to the cord guide 16 during an ironing operation. As can be seen in FIGS. 4-7, a conventional ironing board B is not circular or half circular. Since the ironing board B has an elongate configuration, the cord guide 16 could not maintain the cord C aligned generally tangent to the curvature of the cord guide, where the cord C contacts the cord guide, by making such a curve to have a single radius. Accordingly, in the depicted embodiment it is desirable to provide the contact surface 64 as being a compound curve.

The iron tote 10 also includes the wall stand 18, which is connected with and projects generally rearwardly from the soleplate rest 12. In the depicted embodiment, the wall stand 18 is a wire element that is bent. The wall stand 18 operates to offset the lower portion of the iron tote 10 from the vertical wall W, as seen in FIG. 2. In the depicted embodiment, the wall stand 18 pivots with respect to the soleplate rest 12. The wall stand 18 can pivot between a first position and a second position. With reference to FIG. 2, when in the first position (shown in solid lines in FIG. 2) the wall stand 18 is configured to contact the vertical wall W to position the soleplate resting surface 22 at least about 15 degrees (and more particularly at least about 17 degrees) with respect to vertical. Accordingly, this also offsets the heel resting surface 34 at least about 15 degrees (and more particularly about 17 degrees) with respect to horizontal. When in the second position (shown in phantom in FIG. 2), the wall stand 18 pivots into a storage position.

In the embodiment depicted in FIG. 1, the wall stand 18 connects with a left-hand accessory shelf 70 and a right-hand accessory shelf 72, which will be described in more detail below. In the depicted embodiment, the wall stand 18 is a wire element 74 including a left axle end region 76 that is received in an opening (not visible) formed in the left accessory shelf 70 and a right axle end region (not visible) that is received in an opening (not visible) formed in the right accessory shelf 72. The wire element 74 forming the wall stand 18 bends adjacent each axle end region 76. A left leg 86 extends rearwardly from the left axle end region 76 and a right leg 88 extends rearwardly from the right axle end region. The wire element 74 forming the wall stand 18 then bends again to form a left stop 92 and right stop 94. The left stop 92 contacts the left rear side member 34 when the wall stand 18 is in the first position (as shown in FIG. 1). Likewise, the right stop 94 contacts the right rear member 42 when the wall stand 18 is in the first position, as shown in FIG. 1. The wire element 74 forming the wall stand 18 also includes a base 96, which is generally U-shaped and its terminal ends emanate from respective stops 92 and 94. When the wall stand is in the first position, the base 96 is generally horizontally oriented. When the wall stand is in the second position, the base is generally parallel with the rear side members 38 and 42 and the soleplate resting surface 22. In the depicted embodiment, the wire element 74 is a continuous wire that makes up the left axle end region 76, the left leg 86, the left stop 92, the base 96, the right stop 94, the right leg 88 and the right axle end region (not visible).

The wall stand 18 can be made from materials other than a wire frame construction, e.g. stamped metal, cast metal, plastic, etc. Also, the wall stand 18 can attach elsewhere, for example to the left soleplate rest member 24 and the right soleplate rest member 26, as shown in FIG. 2. In either configuration, the wall stand 18 can pivot between a use position (shown in solid lines in FIG. 2) and a storage position (shown in dashed lines in FIG. 2).

As mentioned above, the iron tote 10 can also include accessory shelves 70 and 72. Each accessory shelf 70, 72 connects with and projects from a respective side of the soleplate rest 12. More particularly, the left accessory shelf 70 engages the left soleplate rest side member 24 and the left rear side member 38. The right accessory shelf 72 engages the right soleplate rest side member 26 and the left rear side member 42. The left accessory shelf 70 is similarly configured to the right accessory shelf 72; therefore, a specific description of the left accessory shelf 70 will only be provided understanding that the right accessory shelf 72 will have the same or very similar configuration.

The left accessory shelf 70 includes a base 100 defining a generally planar support surface 102. A support wall 104 projects upwardly from the base 100 and defines a curved support surface 106. In the depicted embodiment, the generally planar support surface 102 is substantially co-planar with the heel resting surface 34 (FIG. 2). As mentioned above, the soleplate rest 12 and the iron seat 14 are of a wire frame construction thus providing large openings between the wires. The accessory shelves 70, 72, on the other hand, are made from a material that is substantially devoid of openings. The curved support surface 106 is configured to generally match the curvature of a typically sized can of spray starch. The curvature can also follow the typical size of a water spray bottle and a lint roller.

The iron tote 10 can be sold as a knocked down kit where the wire frame construction making up the soleplate rest 12, the iron seat 14, the cord guide 16 and the wall stand 18 are pre-assembled and connected to one another and the purchaser of the kit can connect the accessory shelves 70 and 72. Accordingly, an iron tote 10 is provided that allows an operator to carry the implements that are used when ironing in a very efficient manner so that the equipment used during the ironing operation can be easily accessed during an ironing operation and easily stored when not being used.

Figure 8:
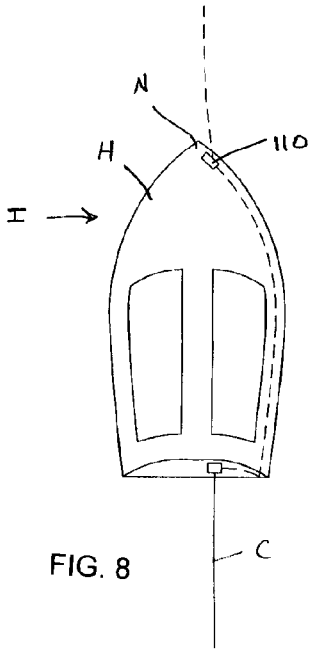
FIG. 8 is a top plan view of an iron having a cord clip attached thereto to depict a "cord forward" configuration.
Figure 9:
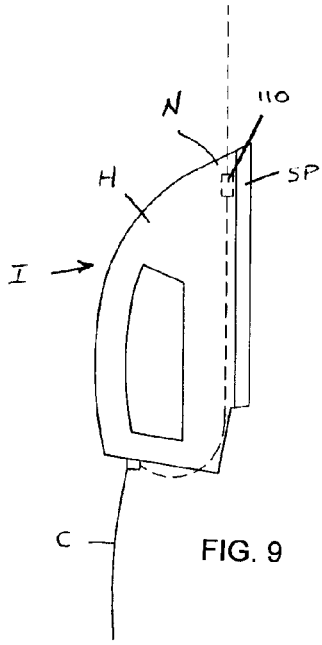
FIG. 9 is a side view of the iron and electrical cord depicted in FIG. 8.

As mentioned above, the iron tote 10 can be sold as part of a kit and the kit can include a cord clip 110. With reference to FIGS. 8 and 9, the cord clip 110 is configured to adhere to the housing H, which is typically plastic, of the iron I. More particular to the depicted embodiment, the clip 110 can be used to hold the electrical cord C for the iron I against the housing H of the iron adjacent a nose N of the iron. This allows the operator of the iron to operate the iron in a "cord forward" manner. In other words, the electrical cord C (shown in dashed lines connected with the clip 110 in FIGS. 8 and 9) protrudes from the forward end, or nose N, of the iron I, as opposed to extending from the rear, or heel, of the iron (shown in solid lines in FIGS. 8 and 9).

Figure 10:
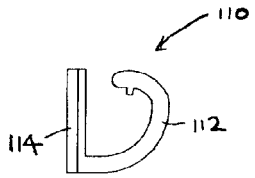
FIG. 10 is an end view of a cord clip such as the one depicted in FIGS. 8 and 9.

As seen in FIG. 10, the cord clip 110 includes a hook feature 112 that is configured to retain the electrical cord C of the iron I and an adhesive element 114 that is configured to stick to the housing H of the iron I. The cord clip 110 can be configured to attach to the iron I in other conventional manners, e.g. a magnetic connection, a hook and loop fastener connection, etc.

Figure 11:
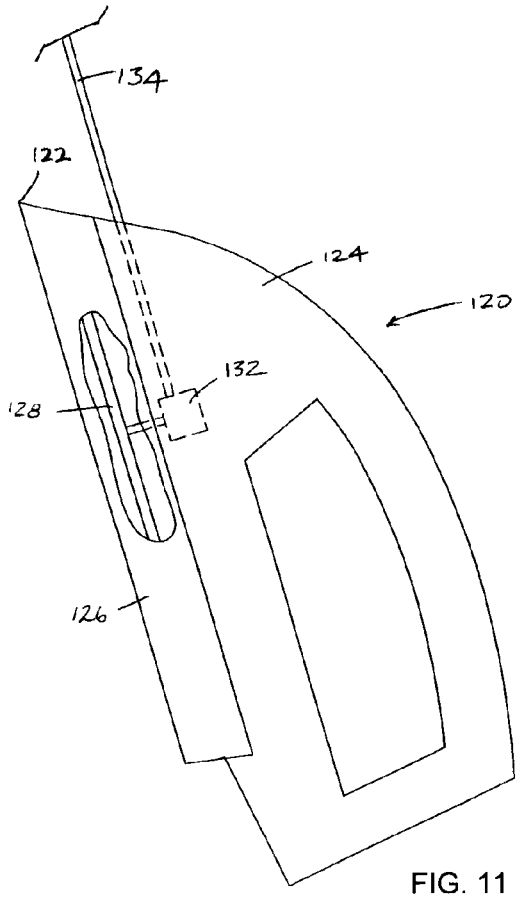
FIG. 11 depicts an iron having a "cord forward" orientation.

FIG. 11 depicts an iron 120 where the cord extends from a nose 122 of the iron, as opposed to the heel. The nose 122 is generally where the iron has its pointed end. The iron 120 is similar to a conventional iron, such as the iron I shown in FIGS. 8 and 9, but the iron 120 is configured to have a "cord forward" orientation without requiring the clip 110. The iron 120 includes a housing 124 and a soleplate 126. The iron 120 also includes a heating element 128, which is similar to a conventional heating element. The heating element 128 is electrically connected via circuitry 132 (depicted schematically in FIG. 11) to an electrical cord 134. The electrical cord 134 exits the housing 124 and/or the soleplate 126 and extends from the housing adjacent the nose 122.

Figure 4:
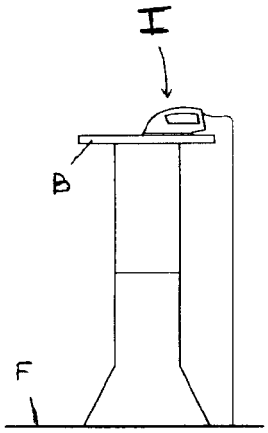
FIG. 4 is an end view of a typical ironing operation showing an ironing board and an iron.
Figure 5:
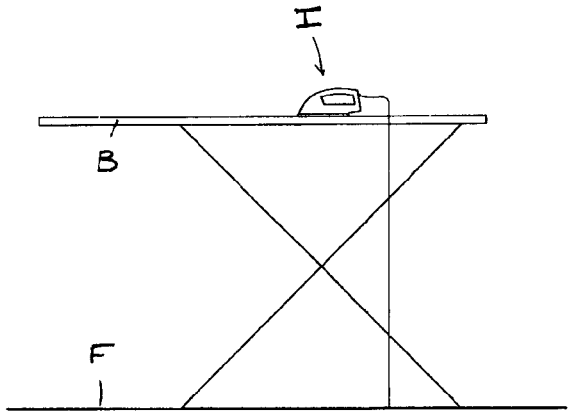
FIG. 5 is a side view of the ironing operation shown in FIG. 4.
Figure 6:
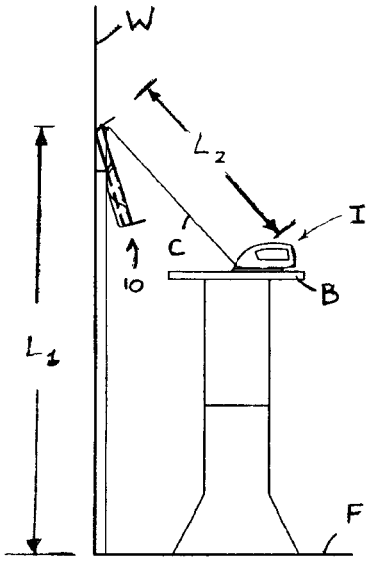
FIG. 6 is an end view of an ironing operation employing the iron tote depicted in FIGS. 1 and 2 and a cord clip.
Figure 7:
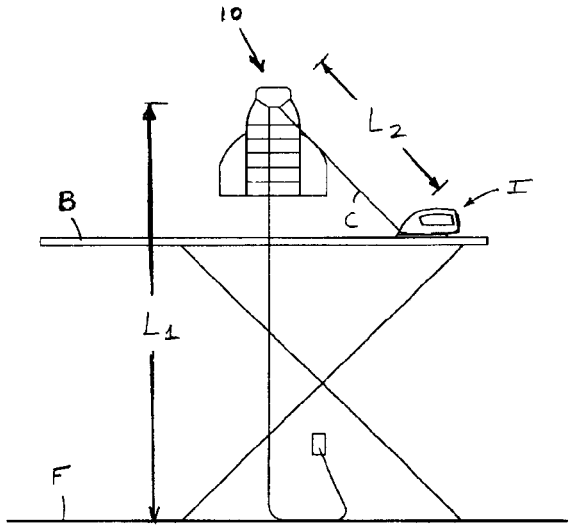
FIG. 7 is a side view of the ironing operation depicted in FIG. 6.

Reference will now be made to FIGS. 4-7, which depict a known ironing operation in FIGS. 4 and 5 and an ironing operation using the iron tote 10 and cord clip 110 in FIGS. 6 and 7. The ironing operation depicted in FIGS. 6 and 7 is also applicable to the iron 120 depicted in FIG. 11 in that FIGS. 6 and 7 depict an iron having a "cord forward" orientation.

FIG. 4 depicts the iron I with the electrical cord C extending from the heel of the iron. When in this orientation, no matter which longer side of the board B the operator of the iron stands on, the cord C that projects from the heel of the iron I extends toward the user and can become entangled underfoot and interfere with any items on the ironing board B.

On the other hand, a method for operating an iron can include holding the electrical cord C for the iron I against the housing H of the iron adjacent a nose N of the iron using a clip 110. Alternatively, the iron 120 depicted in FIG. 11 having the "cord forward" orientation would operate in much the same manner. The method can further include passing the electrical cord C over a cord guide 16 (FIG. 1) positioned above an ironing board B such that a length $L_1$ of cord extending from the cord guide to the lowermost location of the electrical cord, with respect to the floor F, is greater than a length $L_2$ of cord extending from cord guide to the iron. The method can also include maneuvering the iron over an item that is to be pressed. With the length $L_1$ being greater than the length $L_2$, the mass of the electrical cord between the cord guide and the lowermost location of the electrical cord pulls against the mass of the cord between the cord guide and the iron so that the cord retracts over the cord guide as the iron moves closer to the iron tote 10. This conveniently takes the electrical cord away from the ironing board surface thus keeping it out of the way of the operator of the iron. Accordingly, it can be desirable to position the iron tote 10 above the ironing board B such that $L_1$ is greater than $L_2$ no matter the location of the iron I on the ironing board. Furthermore, it can be desirable to hang the iron tote 10 above the ironing board B, wherein the ironing board has two longer sides on opposite sides of the board and to stand on the side of the ironing board opposite the side nearest the iron tote while maneuvering the iron over an item that is to be pressed. For example, one would stand on the side of the ironing board opposite the wall W in FIG. 6.

An iron tote, a kit including an iron tote, a method for operating an iron, and a "cord forward" iron have been described with particularity. Modifications and alterations will occur to those upon reading and understanding the preceding detailed description. The invention, however, is not limited to only the embodiment described above. Instead, the invention is broadly defined by the appended claims and the equivalents thereof.

It will be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An iron tote comprising:

a soleplate rest defining a soleplate resting surface for the soleplate of an associated iron;

an iron seat connected with and projecting generally forwardly from the soleplate rest, the iron seat defining a heel resting surface oriented generally normal with the respect to the soleplate resting surface;

a cord guide connected with the soleplate rest above the iron seat, the cord guide having a contoured contact surface along which an electrical cord of the associated iron rides during operation of the iron; and a wall stand connected with and projecting generally rearwardly from the soleplate rest, wherein the wall stand pivots with respect to the soleplate rest, wherein the wall stand pivots between a first position and a second position, when in the first position the wall stand is configured to contact an associated vertical wall to position the soleplate resting surface at least about 15 degrees with respect to vertical.

2. The iron tote of claim 1, further comprising an accessory shelf connected with and projecting from a side of the soleplate rest.

3. The iron tote of claim 2, wherein the accessory shelf includes a base defining a generally planar support surface and a support wall projecting upwardly from the base and defining a curved support surface.

4. The iron tote of claim 3, wherein the generally planar support surface is substantially coplanar with the heel resting surface.

5. The iron tote of claim 3, wherein the soleplate rest and the iron seat are wire frame construction and the accessory shelf is made from a material that is substantially devoid of openings.

6. The iron tote of claim 1, further comprising side members connected with the soleplate rest, wherein the wall stand includes a stop on the wall stand that contacts at least one of the side members when the wall stand is in the first position.

7. An iron tote comprising:

a soleplate rest defining a soleplate resting surface for the soleplate of an associated iron wherein the soleplate rest includes left and right soleplate rest side members interconnected by a plurality of cross members;

an iron seat connected with and projecting generally forwardly from the soleplate rest, the iron seat defining a heel resting surface oriented generally normal with the respect to the soleplate resting surface;

a cord guide connected with the soleplate rest above the iron seat, the cord guide having a contoured contact surface along which an electrical cord of the associated iron rides during operation of the iron; and a wall stand connected with and projecting generally rearwardly from the soleplate rest.

8. The iron tote of claim 7, wherein the soleplate rest side members and the cross members are made from wire.

9. The iron tote of claim 7, wherein the iron seat comprises a portion of a wire element including rear side members rearwardly offset from the soleplate rest side members.

10. The iron tote of claim 9, further comprising a lifting handle connecting the soleplate rest side members to the rear side members.

11. An ironing accessory kit comprising the iron tote of claim 7 in combination with a cord clip configured to adhere to the housing of the associated iron.

12. The kit of claim 11, further comprising first and second accessory shelves each configured to connect with and extend from a side of the soleplate rest.

13. The kit of claim 11, further comprising a hanger including a loop feature for engaging a fastener.

14. The kit of claim 13, wherein the hanger engages the iron tote for hanging the iron tote from a vertical wall.

15. A method for operating an iron, the method comprising:

holding an electrical cord for the iron against a housing of the iron adjacent a nose of the iron using a clip;

maneuvering the iron over an item that is to be pressed.

16. The method of claim 15, wherein the cord guide is a component of an iron tote including a soleplate rest, an iron seat and a wall stand.

17. The method of claim 16, further comprising:

passing the electrical cord over the cord guide positioned above an ironing board such that a length ($L_1$) of cord extending from the cord guide to a lowermost location of the electrical cord is greater than a length ($L_2$) of cord extending from the cord guide to the iron.

18. An iron comprising:

a housing;

a soleplate connected with the housing;

a heating element positioned adjacent the soleplate;

an electrical cord electrically connected with the heating element and extending from the housing or the sole plate adjacent a nose of the iron.

* * * * *